US008109474B2

(12) United States Patent
Bartek

(10) Patent No.: US 8,109,474 B2
(45) Date of Patent: Feb. 7, 2012

(54) DUAL ULTRASONIC TRAIN DETECTOR

(76) Inventor: Peter M. Bartek, Ledgewood, NJ (US)

( * ) Notice: Subject to any disclaimer, the term of this patent is extended or adjusted under 35 U.S.C. 154(b) by 193 days.

(21) Appl. No.: 12/592,452

(22) Filed: Nov. 27, 2009

(65) Prior Publication Data

US 2011/0127389 A1 Jun. 2, 2011

(51) Int. Cl.
*B61L 25/02* (2006.01)

(52) U.S. Cl. ..... 246/124; 246/167 A

(58) Field of Classification Search ..... 246/124, 246/202, 167 A, 249, 255, 297
See application file for complete search history.

(56) References Cited

U.S. PATENT DOCUMENTS 3,167,282 A * 1/1965 Reigh ..... 246/124
4,954,216 A * 9/1990 Hunter et al. ..... 216/22
5,628,479 A * 5/1997 Ballinger ..... 246/249
5,727,758 A * 3/1998 Penza et al. ..... 246/124
5,907,294 A * 5/1999 Welte et al. ..... 340/903
5,924,651 A * 7/1999 Penza et al. ..... 246/124
6,113,037 A * 9/2000 Pace ..... 246/124
6,145,792 A * 11/2000 Penza et al. ..... 246/167 A
6,324,912 B1 * 12/2001 Wooh ..... 73/629
6,471,162 B1 * 10/2002 Pace ..... 246/294
6,742,392 B2 * 6/2004 Gilmore et al. ..... 73/643
7,429,935 B1 * 9/2008 Brenner ..... 340/907
7,624,952 B1 * 12/2009 Bartek ..... 246/124
7,942,058 B2 * 5/2011 Turner ..... 73/602
2002/0088904 A1 * 7/2002 Meyer ..... 246/124
2011/0127389 A1 * 6/2011 Bartek ..... 246/124

* cited by examiner

*Primary Examiner* — S. Joseph Morano
*Assistant Examiner* — Jason C Smith
(74) *Attorney, Agent, or Firm* — William Nitkin

(57) ABSTRACT

A train detector having dual ultrasonic sensors positioned adjacent to a rail for sensing the movement thereby of a train wheel and determining the direction and speed of the train for transmitting such information to nearby workers and signal devices and a method of train detecting are disclosed.

6 Claims, 2 Drawing Sheets

DUAL ULTRASONIC TRAIN DETECTOR

BACKGROUND OF THE INVENTION

1. Field of the Invention

The device and method of this invention reside in the field of railroad warning systems for train operators, railroad personnel and others working in the vicinity of railroad tracks to give train operators warning of railroad personnel near the train tracks and to give train workers, railroad personnel and others warning of oncoming trains, and more particularly relate to a portable train detector and method of detecting a train on a train track.

2. Description of the Prior Art

In the fields of light rail vehicles, trolley lines, third rail-powered vehicles and tramways, alerting work crews or railroad personnel on or near the tracks of an oncoming train or vehicle, herein referred to as a "train," has been addressed by many methods. Since working on tracks can involve work methods such as digging, hammering and other loud-noise producing acts, workers frequently cannot hear oncoming trains and are in great danger of being struck by such oncoming trains. Also, when individuals, such as first responders, police, firemen, EMS personnel, and track inspectors are on the tracks responding to an emergency or incident, they also are in danger of being struck by such oncoming trains. One of the oldest warning methods employs flag men or whistle men who are positioned a distance away from the workers, such as 3,000 ft., 2,000 ft. or a distance related to the stopping distance of a train from a work crew, in both directions of the track who signal with their flags and/or their whistles to warn of oncoming trains. Due to lack of worker attention or distracting ambient noise, work crews sometimes do not see a flag waving or hear a whistle blowing so that these warning methods can often not be reliable. Further, none of the previous or current warning systems gives an early alert to first responders, police, firemen, track walkers, track work gangs, and track inspectors that a train is approaching.

More recently the train operator can receive warnings by radio that workers are on the tracks in the train's vicinity, but frequently because of poor radio reception in tunnels and track curves and because trains require long distances to stop, such warnings can be ineffective.

Many patents have issued on railroad personnel warning devices, such as U.S. Pat. No. 3,167,282 to S. R. Hursh et. al., which teaches a railroad warning system for warning a work gang working on a railroad track of an approaching train by means of using a train detector physically connected to the track which is activated by having an electrical circuit completed by the pressure of the train's wheels passing thereover. When activated, the device sends a signal to radio receivers and also sets off an audible alarm while at the same time notifying the train operator that a work gang is on the track ahead. This type of system has been improved upon, such as in U.S. Pat. No. 5,924,651 to Penza et. al. where a train transmitter is coupled to a loop buried permanently underneath railroad tracks. Once the train passes over the loop, the warning radio frequency signal can be directed to receivers worn by at least one of the workers in proximity to the railroad tracks to warn such workers of an approaching train in sufficient time for the workers to move away from the tracks. Since many workers can wear the portable radio frequency receivers, they do not need to rely upon others nearby to give them notice of the approach of a train. Such pager-like systems can include vibratory alarms which help to notify workers in loud-noise work zones. The Penza warning system not only can include portable receivers such as portable paging devices, but also can generate an output signal to activate a visual display, such as flashing lights and the like. The Penza system can utilize a control base positioned near the workers, which base can also receive a signal from a transmitter that is installed within the train or such transmitter can be coupled to a loop buried underneath the railroad tracks to sense when the train is passing by and can send a warning signal in sufficient time for the workers to clear the tracks. The use of a loop buried underneath the track or of a pressure transducer positioned on the track to detect the presence of a train or any metal object near the track fails to provide information about the direction and speed of a train on the track. Further, detectors using the interruption of electromagnetic fields are not a consistent means of detecting single track objects as an electromagnetic field can propagate between 8-10 feet and can possibly detect trains on adjacent tracks. Thus they are not single track specific. A further disadvantage in using permanent electromagnetic field sensing devices is that they are susceptible to theft since they are only activated by the presence of large metallic objects, such as trains. Thus there is no warning if such devices are removed.

U.S. Pat. No. 6,471,162 to Pace teaches a system that can be controlled and positioned by workers on the tracks near where they are working to give them advanced notice of an oncoming train. In Pace a train detector probe can be placed near the train tracks at a predetermined distance from the work crew which train detector probe detects an oncoming train by electromagnetic probes which detect changes in the nearby electromagnetic field from the presence of a metallic object and transmit a radio frequency signal to a receiver in the vicinity of the work crew. The system is portable, operating on rechargeable batteries or solar power, and can include multiple warning devices for alerting two or more work crews in a construction zone which has multiple active railway tracks therein. Welte et al, U.S. Pat. No. 5,907,294 teaches an early warning system for warning persons near a track work site of approaching trains using an ultrasonic sensor to detect vibrations on the running rail. The ultrasonic sensor must be in contact with the running rail and detects any form of vibration on the running rail, but such vibration detection is not determinative of the direction of actual train movement. Such means of detection is unreliable because it is susceptible to being activated when the train movement causing vibration is taking place on an adjacent track. Further, the use of an ultrasonic sensor to detect rail vibration is not capable of detecting train speed or direction since the ultrasonic sensor is either pointed directly at the rail or is touching the rail. These aforementioned warning systems do not give early warning to the train operator or to workers on the track.

SUMMARY OF THE INVENTION

It is an object of the present invention to provide an improved portable train detector (PTD) and method over those used in the prior art for warning workers, railroad personnel and others of an oncoming train so that they can safely get off the tracks. This invention also alerts the operator of an approaching train of the presence of other train(s), workers, railroad personnel and others, such as track walkers and the like on the track. The PTD detects the presence of a passing train and sends a secured wireless signal to workers that are wearing personal armband devices and/or sends such signals to activate portable warning lights and/or horns in the work zone. The PTD includes first and second ultrasonic transducers mounted 10 inches apart and facing the track and train wheels. The dual ultrasonic transducers of this invention are also herein referred to as activation sensors, and they not only detect the movement of an approaching train but also the direction and speed of the train up to 170 mph. The dual ultrasonic train detector of this invention further includes an embodiment that can be used in single track operations where the train movement can be in either direction on one track. The dual ultrasonic train detector of this invention transmits and receives sonic energy within a 20-inch maximum sensing range. The train detector operates on 12 to 24 VDC and employs piezoelectric materials to produce such sonic energy with microprocessors to aid in the computations necessary to obtain the desired information, as described below. The sensors used in this invention detect only the designated objects through a "window" and are designed to ignore other surrounding sonic information which might otherwise interfere with the signal. Each sensor of this invention can be adjusted within the sensing window between a near and far limit and can be set anywhere within the sensing range between 20 inches to as little as 0.25 inch. Each sensor can be equipped with a two-color status LED to show the state of output. When the output is active, the LED can be amber; and when the output is inactive, the LED is green. Thus the LED serves to show the sensing status of the sensor. During operation the sensor continually measures the elapsed time from the first pulse's reflected echo received after a pulse transmission. This transmitted pulse starts a clock to register the elapsed time to the first pulse echo received. The microprocessor calculates the distance the sonic signal has traveled out to the wheel of the train along with the time the signal travels back to the sensor using the formula: D–T Vs/2 where D=the distance from the sensor to the train; T=the elapsed time between the pulse transmission and its first received echo; and Vs=the velocity of sound which is approximately 1100 ft/sec. During operation the calculated distance D between the sensor and the train is compared to the distances associated with the window limits. Once the detection unit of this invention is secured in place adjacent to the track and the activation key is turned to the "on" position, the dual sensors accurately measure the elapsed time from the first pulse echo received after each pulse transmission and determine whether the window is clear of any movement or object detection. If the detection unit is removed while the key is still in the "on" position, the elapsed time from the first pulse echo received after each pulse transmission determines that the window has changed and that such movement is thus detected and will activate and send a disruption signal to the microprocessor. Thus such sonic signals can also indicate the detector's removal from a location which feature aids in its timely replacement, if stolen. The dual ultrasonic train detector can be positioned perpendicularly to the track a distance 0.25-20 inches therefrom and is positioned no higher than the running rail. It is important that when spacing the detector between 0.25-20 inches from the track that the detector be positioned no higher than the running rails of the train so that the detector will be within non-fouling areas of the train to avoid having the train strike and damage the detector. Further, since the detector of this invention senses both metallic and nonmetallic objects, it is important to be able to adjust the distance of activation so that the ultrasonic sensors will only detect and activate the detector when a train moves through the area of sensing. By having two redundant sensors, the device of this invention can verify that the object is a large mass, such as a train wheel, which will cause the device's activation and can distinguish such large mass from smaller masses, such as a person walking too close to the detector to prevent the detector's activation. Further, the dual sensor redundancy acts to only activate when there is a train on the track that the device is affixed to and not when there is a train on an adjacent track. The ultrasonic sensors are aimed at a 45 degree angle upwards from the horizontal plane of the track rail so as to sense the train's wheels on the rail. If the sensors are not set at such 45 degree angle, they may incorrectly identify the running rail as the large object that the sensor is trying to detect. By having the sensors aimed at a 45 degree angle, it ensures that the sensors will "see" over the running rail and activate based only on the pattern being the train's wheel sensed within the 0.25-20 inch range. Generally the dual ultrasonic sensors can be placed within a single housing spaced 10 inches apart from one another which distance allows enough space apart to measure time and distance from one sensor's activation to the other which information is utilized by the microprocessor which has a programmed algorithm to determine the train's speed and direction. In a preferred embodiment the sensors can be disposed under a protective guard a distance of about 0.25-20 inches from the rail so as to detect movement of the wheels of a passing train on the rail. By using thin 1/10 inch diameter waves, the ultrasonic sensors can sense the train's travel direction when the train wheel passes between the first ultrasonic sensor and the second ultrasonic sensor. Further, by using such 1/10 inch diameter waves and determining the time of activation, the device can then determine not only the direction, but also the speed of the passing train. When a train's wheel passes the first sensor, the sensor sends a signal to the microprocessor which logs the time of the signal. When the same wheel then passes the second sensor, that sensor sends a signal to the microprocessor which also logs the time. The microprocessor can then determine how long it took between the activation of the first sensor and the second sensor. By knowing that both sensors are 10 inches apart, the microprocessor can determine the speed of the train at the point that it passed the detector. Also, since the microprocessor records when each of the dual sensors was activated, it can determine which sensor was activated first and utilize the second sensor to verify the activation, therefore determining the direction of travel of the train. This feature allows the dual ultrasonic sensors to be placed adjacent to a track having single track operation thereon, and the dual ultrasonic sensor train detector can, for example in one embodiment, be set to activate when a train enters the work zone but not when the train exits the work zone. The device of this invention can be attached on either rail of a track on either the inside or outside of such rail. By providing for the ultrasonic sensors to have a wave sensing distance of between 0.25-20 inches at a 45 degree angle from a horizontal plane, it allows the activation of the ultrasonic sensors only by the trains traveling on the track on which the device of this invention is installed and prevents activation of the device by trains on adjacent tracks. Further, by using the wave sensing distance of between 0.25-20 inches at such 45 degree angle, the device can be set to activate in inclement weather, if desired, such as in heavy snow or heavy rain. Such heavy rain or heavy snow can cause a signal pulse echo to be received after each pulse transmission.

The dual ultrasonic train detector of this invention is mounted on a mounting plate adapted to fit between two railroad ties with slots to allow for sliding of the device's housing back and forth under the rail for adjustments before being tightened in place. The tightening clamps can also be utilized in conjunction with different size running rails. The mounting system of this invention can further be utilized between both traditional rail ties and concrete ties and can be adapted for three different size running rail heights. Due to the low profile of the device of this invention, it is generally disposed below the running rail top height with its low profile housing not being higher than the height of the running rail to allow for an easy fit on or beside any track without becoming an obstruction to any object, such as the train that is higher than the top of the running rail.

It is a further goal of this invention that the weight of the dual ultrasonic train detector be under 10 lb. for easy carrying and installation.

DESCRIPTION OF THE PREFERRED EMBODIMENT(S)

Figure 1:
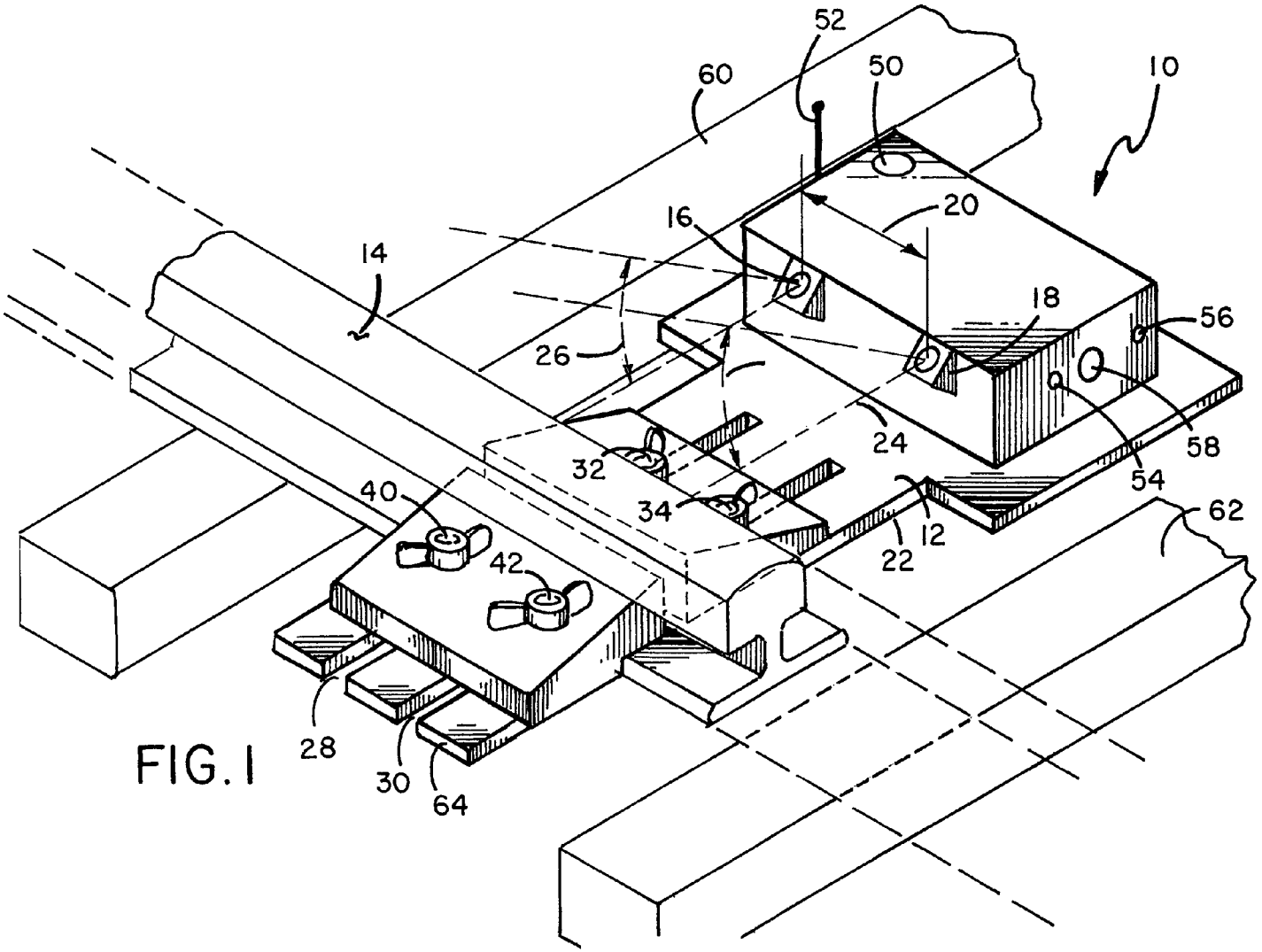
FIG. 1 illustrates a perspective view of the dual ultrasonic train detector of this invention mounted on a mounting plate disposed under a railroad track with the dual ultrasonic sensors adjustably positioned a distance from the track and aimed at a 45 degree angle toward the track.
Figure 2:
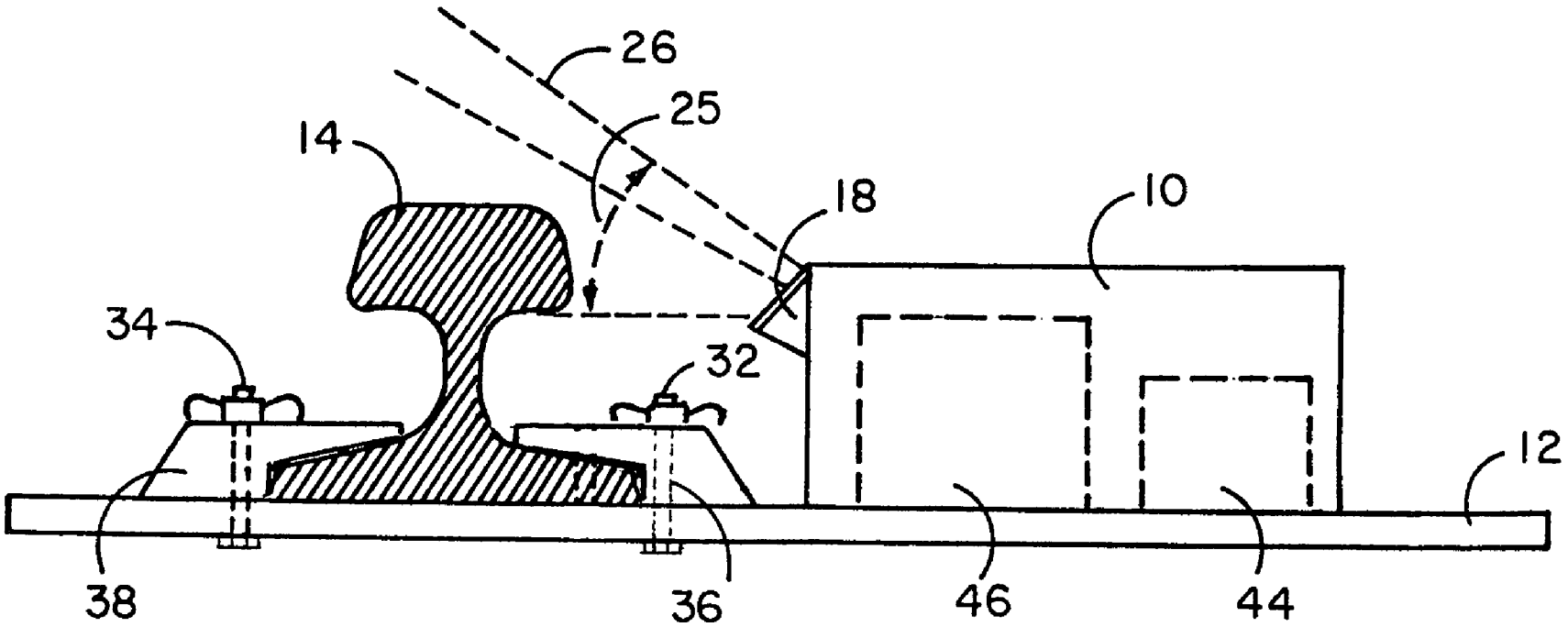
FIG. 2 illustrates a side view of the device of this invention.

FIG. 1 illustrates a perspective view of portable train detector 10 of this invention mounted on mounting plate 12. Within mounting plate 12 are defined two parallel elongated first and second slots 28 and 30 which extend to end 64 of mounting plate 12. Mounting plate 12 can be made of a nonconductive material, and it extends under track 14 between first tie 60 and second tie 62. The mounting plate is disposed immediately under the track and clamped thereto to position the portable train detector 10 a selected distance 22 from track 14. When portable train detector 10 is at the desired distance in the range between 0.25-20 inches from track 14, first clamp 36 and second clamp 38, as seen in FIG. 2, are attached, respectively, by first and second bolts 32 and 34, extending through first and second slots 28 and 30, respectively, against one side of the base of track 14 with the second clamp 38 affixed by third and fourth bolts 40 and 42, also passing through first and second slots 28 and 30 such that when first and second bolts 32 and 34 and third and fourth bolts 40 and 42 are tightened, first and second clamps 36 and 38 are tightened downward against each side of the base of track 14 to hold mounting plate 12 securely in place with portable train detector 10 at the desired distance 22 from track 14. When a worker installs the device under the running rail, the worker can adjust the base back and forth to the desired distance from the rail before tightening the bolts. The worker can determine the desired distance when the red LED light on the detector unit turns off which indicates that the unit is correctly positioned. The bolts can be tightened by having wing nuts on their tops so that when the base is in the desired position, the worker can manually rotate the wing nuts to tighten the clamps against the track which in turn secures the mounting plate under the track in the desired location. Portable train detector 10 has first and second ultrasonic detectors 16 and 18 disposed on its side facing track 14 which first and second ultrasonic detectors 16 and 18 are positioned approximately a distance 20 apart from one another which, in a preferred embodiment, can be 10 inches. First and second ultrasonic detectors 16 and 18 are aimed at approximately a 45 degree angle upwards from a horizontal line 24 on a 45 degree angled plane 26, shown in dashed lines, which positioning allows the first and second ultrasonic sensors 16 and 18 to sense the train's wheels traveling above the track at any distance that portable train detector 10 is positioned from the track 14. As the wheels of the train go over track 14, first ultrasonic detector 16 or second ultrasonic detector 18 will first detect the oncoming train's wheels depending on the train's direction of travel. Also, the ultrasonic detector, because of its use of a short wave length, can be programmed to determine the direction and speed of the train passing on the track. In a preferred embodiment, portable train detector 10 has a low profile, that is, its height is not higher than the top of track 14; and in a preferred embodiment its weight is generally under 10 lbs. so that it can be easily transported. Portable train detector 10 includes an RF module 46 which can have a transmitter therein and a battery pack 44 to power the unit. RF module 46 can include two radio frequency transmitters broadcasting at 900 MHz to transmit the signal once a train is detected. Such signal can be sent not only to personal armbands worn by workers which sound an alarm when activated, but also to portable warning horns and lights. RF module 46 can be interconnected to an antenna connector 50 to which can be attached an antenna, such as antenna 52. On one side of portable train detector 10 can be disposed battery status indicator 54 and an input plug 56 along with an on/off test switch 58 which can be a key switch.

Portable train detector 10 is specifically designed to fit between the rail ties which can be composed of wood, concrete or composite material, and the clamps which attach the mounting plate to the track can have an inside angle that will accept three track sizes to fit against the base of the rails of three different rail heights. Nonconductive mounting plate 12 can be, in a preferred embodiment, approximately 24 inches long and approximately 0.5 inch in depth.

Although the present invention has been described with reference to particular embodiments, it will be apparent to those skilled in the art that variations and modifications can be substituted therefor without departing from the principles and spirit of the invention.

I claim:

1. A portable train detector for installing adjacent to a selected rail of a train track, a train being on said track, said rail having a length, a top, a base and a bottom, said train having wheels, comprising:

a housing;

at least one ultrasonic transducer positioned within said housing, said transducer(s) producing and detecting ultrasonic pulses aimed upwards above the top of said selected rail, such ultrasonic pulses striking and reflecting off a wheel of said train for detection of said train;

wherein said housing is laterally positionable perpendicular to said length of said selected rail for placing said transducer(s) in a plane a distance from said rail;

transmitting means disposed within said housing for broadcasting the detection of said train on said track;

mounting means for positioning and mounting said housing in alignment with and adjacent to said selected rail;

first and second ultrasonic transducers positioned within said housing a distance apart from one another, said first and second transducers producing and detecting said ultrasonic pulses aimed upwards from said plane at approximately a 45 degree angle to a point above said top of said selected rail;

said first and second ultrasonic transducers positioned approximately 10 inches apart from one another;

said mounting means have a length and an axis, said mounting means positioned under said selected rail of said track;

said housing mounted on said mounting means; and clamping means for engaging said mounting means to said base of said selected rail, said mounting means being laterally positionable perpendicular to said length of said selected rail so as to place said first and second transducers a distance of between 0.25 inch-20 inches from said selected rail, said clamping means being tightenable to said selected rail when said housing is at a selected distance from said selected rail.

2. A portable train detector for installing adjacent to a selected rail of a train track, said selected rail having a length, a top, a base and a bottom, said train having wheels, comprising:

an elongated planar mounting plate having an upper surface, said mounting plate having first and second ends defining a length and an axis extending therebetween, said first end positioned under said selected rail of said track;

first and second elongated slots defined in said mounting plate extending from said first end toward said second end;

a housing mounted on said upper surface of said mounting plate at said second end thereof;

first and second windows defined within said housing, said first and second windows facing said first end of said mounting plate and said selected rail, said first and second windows positioned approximately 10 inches apart from one another;

first and second ultrasonic transducers positioned within said housing, said first and second transducers positioned, respectively, behind said first and second windows, said first and second transducers producing and detecting an ultrasonic pulse aimed upwards at approximately a 45 degree angle from said axis of said mounting plate to a point above said top of said selected rail, such pulses striking and reflecting off a wheel of said train and causing said first and second transducers to produce activation signals;

clamping means engaged through said first and second elongated slots and said base of said rail, said mounting plate being laterally positionable perpendicular to said length of said selected rail so as to place said first and second windows a distance of between 0.25 inch-20 inches from said selected rail, said clamping means being manually tightenable when said housing is at a selected distance from said selected rail;

computing means disposed within said housing for receiving said activation signals when said train wheel is struck by said ultrasonic pulses, such ultrasonic pulses being reflected back to said first and second transducers, said computing means for determining the direction of travel and speed of said train based upon the time of activation of said first and second ultrasonic transducers; and transmitting means disposed within said housing for broadcasting the detection of a train on said track along with the determinations of said computing means.

3. The portable train detector of claim 2 wherein said mounting plate has a length and wherein said first and second slots are defined parallel to one another within said mounting plate and parallel to said length and axis of said mounting plate and perpendicular to said length of said selected rail; and wherein said clamping means are positioned over said rail base, said clamping means having first and second bolts extending therefrom, said first and second bolts slideably engaged, respectively, in said first and second slots for manual lateral movement of said mounting plate under said selected rail along an axis perpendicular to said length of said selected rail to a desired position for positioning said first and second windows a distance from said selected rail, said clamping means further including manual tightening means for tightening said clamping means against said rail base and said upper surface of said mounting plate to said bottom of said selected rail when said desired positioning of said first and second ultrasonic transducers from said selected rail has been achieved.

4. A method of detecting a train on a train track having two rails, comprising the steps of:

installing a housing adjacent to a selected rail of said train track, said selected rail having a length, a top, a base and a bottom, said train having wheels;

providing an elongated planar mounting plate having an upper surface, said mounting plate having first and second ends defining a length and an axis extending therebetween;

positioning said first end of said mounting plate under said selected rail of said track;

providing first and second elongated slots in said mounting plate extending from said first end toward said second end;

mounting said housing on said upper surface of said mounting plate at said second end thereof;

providing first and second windows spaced apart from one another within said housing, said first and second windows facing said first end of said mounting plate and said selected rail;

providing first and second ultrasonic transducers positioned within said housing;

positioning said first and second transducers, respectively, behind said first and second windows;

aiming said first and second transducers upwards at approximately a 45 degree angle from said axis of said mounting plate to a point above said top of said selected rail;

producing and detecting ultrasonic pulses by said first and second transducers;

striking a wheel of said train moving on said selected rail by said ultrasonic pulses and reflecting said ultrasonic pulses reflected off said wheel of said train back to said first and second ultrasonic transducers;

computing said produced and received ultrasonic pulses to produce activation signals created when said train wheel is struck by said ultrasonic pulses being reflected back to said first and second transducers;

detecting said train on said selected rail; and transmitting a signal for broadcasting the detection of said train on said track.

5. The method of claim 4 further including the steps of:

positioning said first and second windows approximately 10 inches apart from one another;

positioning said mounting plate perpendicular to said length of said selected rail for placing said first and second windows a selected distance of between 0.25 inch-20 inches from said rail; and clamping said mounting plate to said selected rail when said housing is at said selected distance from said rail.

6. The method of claim 5 further including the steps of:

determining the direction of travel and speed of said train based upon the time of activation of said first and second ultrasonic transducers; and transmitting said determinations of said computing means.

* * * * *